United States Patent [19]

Jahnke et al.

[11] Patent Number: 4,488,513

[45] Date of Patent: Dec. 18, 1984

[54] GAS COOLER FOR PRODUCTION OF SUPERHEATED STEAM

[75] Inventors: Frederick C. Jahnke, Rye; James R. Muenger, Beacon, both of N.Y.

[73] Assignee: Texaco Development Corp., White Plains, N.Y.

[21] Appl. No.: 527,458

[22] Filed: Aug. 29, 1983

[51] Int. Cl.[3] ..... F22B 1/02

[52] U.S. Cl. ..... 122/32; 122/7 R; 165/163

[58] Field of Search ..... 122/32, 7 R, 504, 504.2; 165/157, 163

[56] References Cited

U.S. PATENT DOCUMENTS

| | | | |
|---|---|---|---|
| 1,801,013 | 4/1931 | La Mont | 122/7 R |
| 3,690,374 | 9/1972 | Volhardt | 122/32 X |
| 3,900,010 | 8/1975 | Stitler et al. | 122/32 |
| 3,915,224 | 10/1975 | Richter et al. | 122/32 X |
| 4,263,587 | 4/1981 | John | 122/504.2 |
| 4,307,685 | 12/1981 | Robin et al. | 122/32 |

FOREIGN PATENT DOCUMENTS

| | | | |
|---|---|---|---|
| 1124512 | 3/1962 | Fed. Rep. of Germany | 122/7 R |

*Primary Examiner*—Edward G. Favors

*Attorney, Agent, or Firm*—Robert A. Kulason; Albert Brent

[57] ABSTRACT

A gas cooler and process are provided for the efficient extraction of heat from a hot raw gas stream containing entrained matter from the partial oxidation of a hydrocarbonaceous or carbonaceous fuel, and the simultaneous production of a separate stream of superheated steam. The gas cooler comprises a closed vertical pressure vessel with an upper central outlet through which the superheated steam is removed. A refractory lined hot gas inlet chamber is attached to the bottom of the pressure vessel. A plurality of bundles of helical tubes through which the hot gas flows are spaced in the vessel. The hot gas enters at the bottom of the vessel and the cooled gas leaves at the bottom of the helical coil. A portion of the vessel is filled with boiler feed water so that the bundles of helical tubes are partially submerged. Concurrent and countercurrent indirect heat exchange between boiler feed water and the gas stream takes place in the evaporator section to produce saturated steam. Concurrent and countercurrent indirect heat exchange between the saturated steam and the partially cooled gas stream then takes place in the superheater section to produce superheated steam. Advantageously, the gas cooler may be easily turned up or down with load by opening or closing off at least one of the helical tubes. This may be done by valving located downstream from the gas cooler at the cold end of the gas path.

5 Claims, 1 Drawing Figure

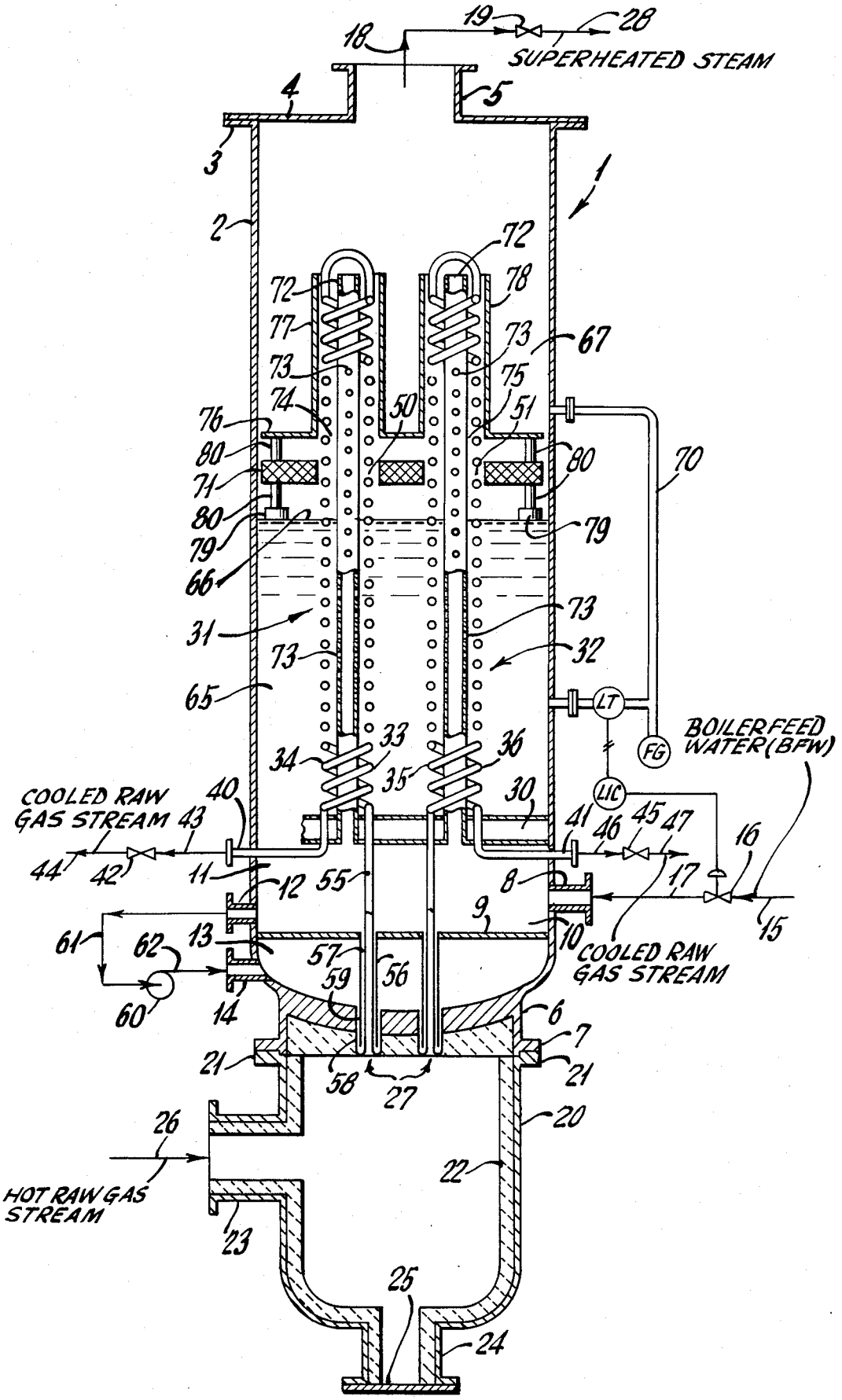
SUPERHEATED STEAM
BOILER FEED WATER (BFW)
COOLED RAW GAS STREAM
COOLED RAW GAS STREAM
HOT RAW GAS STREAM
LT
LIC
FG

GAS COOLER FOR PRODUCTION OF SUPERHEATED STEAM

BACKGROUND OF THE INVENTION

This invention relates to a gas cooler and process for cooling a hot raw gas stream and for simultaneously producing superheated steam. More particularly, it relates to a gas cooler and process for extracting heat from the hot raw gas stream from the partial oxidation process, and the simultaneous production of a separate stream of superheated steam.

Synthesis gas, reducing gas and fuel gas are commonly produced by the partial oxidation of gaseous and liquid hydrocarbonaceous fuel, and from solid carbonaceous fuel. For example, reference is made to the partial oxidation processes described in coassigned U.S. Pat. Nos. 3,620,699; 3,639,261; and 3,998,609.

The raw effluent gas stream comprising $H_2$, CO and entrained particulate matter leaves the reaction zone of the partial oxidation gas generator at a temperature in the range of about 1700°-3000° F. and a pressure in the range of about 10 to 200 atmospheres. The raw gas stream may be cooled to a temperature in the range of about 400° F. to 800° F. by indirect heat exchange with water in a gas cooler or waste heat boiler. By-product saturated steam may be thereby produced. The saturated steam is often superheated in outside equipment, such as a fired heater. In coassigned U.S. Pat. No. 4,099,382, saturated steam that is produced in a downstream heat exchanger is recycled and superheated in another heat exchanger that is located upstream from the downstream heat exchanger. In coassigned U.S. Pat. No. 4,247,302, saturated steam is produced in one or more shell-and-straight fire tube gas coolers and then superheated in another shell-and-straight fire tube gas cooler. A waste heat boiler with helical cooling tubes whose ends are in communication with water cooled gas inlet pipes is described in U.S. Pat. No. 4,029,054. Cooling the inlet ends of gas tubes by means of a coolant is described in U.S. Pat. No. 3,610,329.

SUMMARY OF THE INVENTION

In accordance with the invention, a gas cooler and process are provided for cooling a hot raw gas stream, such as the hot raw effluent gas stream from the partial oxidation of a gaseous or liquid hydrocarbonaceous fuel or a solid carbonaceous fuel, and recovering the sensible heat in the gas stream. The hot gas stream is cooled by first being passed in indirect heat exchange with water in the evaporator section of the gas cooler and then with saturated steam in the superheater section of the gas cooler. Simultaneously, the water is converted into superheated steam in the same vessel.

The gas cooler comprises a closed vertical cylindrically shaped pressure vessel with an upper central outlet for the discharge of superheated steam. The vessel is partially filled with boiler feed water. A plurality of vertical bundles of helical tubes through which the hot raw gas stream flows are supported within a portion of the vessel starting above the lower end. The bundles of helical tubes are radially spaced and are uniformly arranged around the central vertical axis of the vessel. Each bundle comprises at least one continuous ascending and descending helical tube. A water chamber connected to a source of boiler feed water extends between the lower ends of the vertical bundles of helical tubes and the inside bottom of the pressure vessel. This chamber communicates with an overhead interstitial passage formed between the inside wall of the pressure vessel and the outside walls of the plurality of vertical bundles of helical tubes. The boiler feed water contacts the outside surface of the submerged portion of the bundles of helical tubes. The boiler feed water enters the vessel at the bottom, absorbs the sensible heat in the hot raw gas stream, and is converted into saturated steam below the water level. The saturated steam is converted into superheated steam above the water level. A refractory lined hot gas inlet chamber is attached to the lower end of the pressure vessel. The inlet ends for each of the helical tubes begin in the upper portion of the hot gas inlet chamber and are water jacketed for thermal protection. The inlet end for each helical tube then enters the pressure vessel through the bottom wall of the pressure vessel. The inlet end then passes through a horizontal tube sheet which separates the bottom of the vessel into low and high pressure sides. From the top of the vertical bundle, the helical tube containing the partially cooled gas stream coils downward. The descending portion of the helical tube returns through the water to remove the last portion of sensible heat from the raw gas stream. The outlet ends of the helical tubes through which the cooled gas leaves the pressure vessel may penetrate the wall near the bottom of the pressure vessel. Alternative designs use internal headers and thereby reduce the number of wall penetrations.

In the evaporator section of the gas cooler, boiler feed water passes concurrently and countercurrently with the hot gas flowing in the ascending and descending helical tubes, respectively. The water absorbs the sensible heat in the gas stream and is evaporated to produce saturated steam. Substantially all of the saturated steam then passes into the superheater section. There it is superheated by being passed over that portion of the bundle of helical tubes which extends above the water level in the gas cooler. Concurrent and countercurrent heat exchange takes place between the saturated steam and the partially cooled gas stream flowing through the ascending and descending helical tubes, respectively. After the saturated steam is superheated, the descending helical tubes return into the water in the evaporator section in order to remove the last heat from the partially cooled raw gas stream at the lower temperature and higher heat transfer coefficient of the water. The temperature of the superheated steam and that of the raw gas stream entering the superheat section may be controlled by varying the water level in the gas cooler. This control may be necessary to account for varying fouling and process conditions. Baffles may be optionally used in the superheat section to improve the efficiency of the heat transfer. A demister may be optionally used to remove excess water from the saturated steam.

BRIEF DESCRIPTION OF THE DRAWING

The FIGURE is a front elevational view, in section, of the gas cooler comprising the present invention.

DESCRIPTION OF THE INVENTION

A more complete understanding of the invention may be had by reference to the accompanying schematic drawing which shows the subject invention in detail. Although the drawing illustrates a preferred embodiment of the invention, it is not intended to limit the subject invention to the particular apparatus or materials described. The drawing depicts an apparatus for cooling a stream of raw gas, e.g., synthesis gas, reducing gas or fuel gas from the partial oxidation process and simultaneously producing superheated steam. The hot raw gas stream comprises a mixture of $H_2$, CO, $CO_2$ and at least one material selected from the group consisting of $H_2O$, $N_2$, A, $CH_4$, $H_2S$ and COS. Particulate matter, e.g., unconverted carbon, soot, and ash may be also entrained in the raw gas stream. The raw gas stream enters the gas cooler at a temperature in the range of about 1700° to 3000° F., such as about 2200° to 2800° F. and a pressure in the range of about 10 to 200 atmospheres (atms.) such as 35 to 100 atms. The raw gas stream leaves the gas cooler at a temperature in the range of about 400° to 800° F. after being cooled by indirect heat exchange first with boiler feed water, then with saturated steam, and finally with boiler feed water again. The pressure drop of the raw gas stream passing through the gas cooler is about 1-2 atms. The superheated steam that is produced in the gas cooler has a temperature in the range of about 350° to 700° F., such as about 450° to 600° F., and a pressure in the range of about 10 to 210 atms., such as about 45 to 110 atms.

The gas cooler comprises a closed vertical cylindrical shaped steel pressure vessel 1 comprising outer shell 2, top flange 3, top cover plate 4, coaxial central top outlet 5 for the discharge of the superheated steam produced in the gas cooler, lower end 6, bottom flange 7, and main boiler feed water (BFW) inlet 8. Gas inlet tube sheet 9 is located below inlet 8 and divides water inlet chamber 10 into low pressure side 11 with water outlet 12 and high pressure side 13 with water inlet 14. Boiler feed water is introduced through line 15, control valve 16, line 17, and inlet 8. The superheated steam is removed through top outlet 5, line 18, superheated steam control valve 19, and line 28.

Hot raw gas inlet chamber 20 is provided with top flange 21 which is connected to bottom flange 7 of shell 2 by conventional means. Chamber 20 is lined with refractory 22 and is provided with side inlet 23 for the introduction of the hot raw gas stream. It is also equipped with clean-out bottom outlet 24 and flange over 25. The hot raw gas stream entering chamber 20 through line 26 is split into a plurality of separate gas paths which leave chamber 20 through a plurality of outlets 27 in the upper portion of chamber 20. The gas paths run independently with respect to each other, and pass serially through the evaporator and superheater sections of the gas cooler. Advantageously, a minimum effective gas velocity may be maintained in each gas path, even in case of part load operation, by locating an external shut-off valve at the cold end of each gas path.

A plurality of vertical bundles of helical tubes for carrying the raw gas are radially and uniformly spaced within shell 2, and are supported, positioned, and secured by beam structure 30. Other side brackets (not shown) may also be used. Thus, there may be from 2-20 bundles of helical tubes uniformly spaced within shell 2. Each bundle of tubes may have from 1-7 concentric rings, and each ring may have from 2-20 helical tubes. Each helical tube in a bundle of helical tubes starts at the bottom and coils around the central vertical axis of the bundle of helical tubes either clockwise or counterclockwise while moving upward until the top of the tube bundle is reached. At that point the helical tube continues to coil around the central vertical axis of the bundle of helical tubes while moving downward until the bottom of the tube bundle is reached. For example, the present vessel shown in the drawing is provided with two equally spaced vertical bundles of helical tubes in shell 2. Each bundle of tubes has 1 concentric ring containing a continuous ascending and then descending helical tube. Two bundles of helical tubes 31 and 32 are shown partially in cross section in the drawing. The bundle of helical tubes 31 comprises ascending helical tube 33 in series with descending helical tube 34. Similarly, the bundle of helical tubes 32 comprises ascending helical tube 35 in series with descending helical tube 36. At the bottom of the bundles of helical tubes 31 and 32, the outlet sections 40 and 41 of descending helical tubes 34 and 36 respectively, pass through shell 2 with a water-tight seal. The flow of gas through the bundles of helical tubes 31 and 32 may be controlled, for example, by external gas flow control valve 42 in lines 43-44, and by external gas flow control valve 45 in lines 46-47, respectively. For ease of assembly and maintenance, by removing top cover plate 4 all of the vertical bundles of helical tubes as well as the other components within shell 2 may be easily inserted or removed through the upper end of vessel 1.

To prevent thermal damage, each helical tube in each bundle of helical tubes has a water jacketed inlet section. The jacketed inlet section is located between tube sheet 9 and the downstream inlet end of the tube which is located in the upper portion of hot raw gas inlet chamber 20. For example, the water jacket for tube 33 includes pipe 56 that is concentric with and which surrounds inlet pipe section 55 of tube 33, thereby providing annular passage 57. Pipes 56 and 55 pass through tube sheet 9 and lower end 6 of vessel 1. The outside surface of pipe 56 is sealed to tube sheet 9 with a water-tight seal. Pipe 58 passes through lower end 6 of the vessel, and its external surface makes a water-tight seal therewith. Pipe 58 is concentric with and surrounds pipes 56 and 55. Annular passage 59 is provided between pipes 58 and 56. The ends of pipes 58 and 55 are sealed with a water-tight seal. The end of pipe 56 is retracted so that there is communication between the ends of annular passages 59 and 57. Water from high pressure side 13 flows down through the annular passage 59. The direction of flow for the cooling water is then reversed, and the water flows up through the annular passage 57. The cooling water is then discharged into low pressure side 11. The gas inlet sections for all of the other helical tubes in each of the bundles of helical tubes in the annular passage are similarly cooled. Circulating water pump 60 is located outside of vessel 1 and is used to pump water from space 11 by way of outlet 12, lines 61-62, and through inlet 14 into space 13.

Boiler feed water is introduced into vessel 1 by way of inlet 8 and forms a pool of water 65. Vessel 1 is partially filled to water level 66. Space 67 represents the area at the top of vessel 1 that is above water level 66. The liquid level in vessel 1 may be measured by a conventional indicator 70, for example comprising level sensing and transmitter LT and a level indicator and controller LIC. Thus, a conventional differential pressure level detector may be used to measure the liquid level. Responsive to a signal from LT, the introduction of BFW from line 15 into inlet 8 may be controlled by LIC providing a pneumatic or electronic signal to open or close flow control valve 16 in the BFW line. By this means, the water in vessel 1 is controlled at a desired level so that about 25 to 75% such as about 33 to 67% of the surface area of the bundles of helical tubes is submerged in the boiler feed water.

Each vertical bundle of helical tubes extends lengthwise in a portion of vessel 1, and only a portion of each bundle of helical tubes is submerged in boiler feed water 65. The remainder of the bundle of tubes is unsubmerged and extends upward into space 67. The water flowing up through vessel 1 is vaporized by indirect heat exchange with the hot gas stream flowing through the submerged portion of the plurality of bundles of helical tubes. The saturated steam produced passes up through vessel 1 and contacts the outside surface of the unsubmerged portion of the bundles of helical tubes in space 67. The saturated steam is thereby superheated by indirect heat exchange with the hot raw gas stream flowing within the unsubmerged portions of the bundles of helical tubes.

A demister 71 may be placed above water level 66 and between the evaporator and superheater sections of the gas cooler. Demister 71 may be fixed or movable. As shown in the drawing, demister 71 is disc shaped and fits transversely across the inside of shell 2. Demister 71 has two circular holes 50 and 51 through which helical tube bundles 31 and 32 respectively pass. Demister 71 may be made from a wire mesh or other suitable material and removes excess water from the saturated steam flowing up into the superheater section.

Heat exchange in the evaporator and superheater sections may be improved by optionally installing a cylindrical core pipe 72. Pipe 72 extends lengthwise along the central axis of each helical bundle of tubes. Pipe 72 is open at each end and is supported upright, for example by beam 30. For water and steam circulation, a plurality of holes 73 are provided in that portion of the walls of pipe 72 that extends from the point of lowest water level to the top of the pipe.

In one embodiment, fixed or floating baffles are provided in the superheater section in order to improve the efficiency of the heat transfer. The baffles are located above the water level and demister, if any. The baffles guide the upward flow of the saturated steam that is produced in the evaporator section in a path by which the steam makes direct contact with the external surface of the helical gas tubes in the superheater section. For example, as shown in the drawing, the plurality of vertical bundles of helical tubes 31 and 32 pass up through circular holes 74 and 75 respectively in transverse disc 76 located above the water level 66. Vertical cylindrical conduits 77 and 78 have central longitudinal axes which are parallel with that of vessel 1. Conduits 77 and 78 surround the bundles of helical tubes 31 and 32, respectively, in the surrounding region and are radially spaced therefrom. The lower ends of conduits 77 and 78 are attached to disc 76 and the remaining portions of the conduits extend upward along the upper portions of the bundles of helical tubes 31 and 32, respectively and preferably to their ends. While the edges of transverse disc 76 may be fixed to the inside walls of cylindrical shell 2, alternatively disc 76 may be supported above liquid level 66 by float 79 and vertical members 80, as shown in the drawing. Float 79 may be ring-shaped. Float 79 rests on the surface of water level 66, and optionally may also support disc shaped demister 71, as shown in the drawing.

In the drawing, outlet sections 40 and 41 leave from the bottoms of annular bundles of helical tubes 31 and 32 respectively, and pass through the wall of vessel 1 with water-tight seals. In a similar manner, the outlet sections from all other helical tubes in all other annular bundles of helical tubes may penetrate shell 2. Thus, all of the cooled gas leaving from the bottom of the plurality of bundles of helical tubes may be removed from vessel 1 through individual outlet lines. Alternatively, all of the cooled gas from all of the individual helical tubes may be collected in a header (not shown) and then be discharged through a single exit outlet from the header that penetrates the shell of the vessel with a water-tight seal. In another embodiment, at least one gas outlet section of a helical tube passes through the walls of vessel 1, with a water-tight seal. The gas outlet sections for the remaining helical tubes pass into a gas outlet header located within the vessel and make water-tight seals therewith. The header is in direct communication with a single outlet conduit that passes through the wall of the vessel with a water-tight seal.

In another embodiment (not shown), a flanged outlet is provided in the side wall of low pressure space 11 and is covered with a flange plate. The gas outlet sections for all of the tubes in the bundle of helical tubes pass through said flange plate, and make gas-tight seals therewith. Alternatively, in this embodiment, the gas outlet sections for all of the helical tubes pass into a header supported in space 11, and make water-tight seals therewith. The header is in direct communication with a single outlet conduit that passes through said flange plate, and makes a water-tight seal therewith.

Advantageously, when turn-down of the subject gas cooler is required, one or more of the individual helical coils or all of the helical coils that discharge into a header (not shown) may be shut down by external gas flow control valving, such as previously described, without completely shutting down the gas cooler. When the amount and temperature of the hot raw gas stream that is introduced into the gas cooler are fixed, the temperatures of the superheated steam and cooled raw gas leaving vessel 1 may be controlled by varying the water level in the vessel. Steam pressure in the vessel may be adjusted by means of external superheated steam control valve 19.

In order to prevent the unsubmerged portions of the bundles of helical tubes in the superheat section of the gas cooler from overheating, the temperature of the partially cooled raw gas stream leaving the evaporator section is preferably in the range of about 600° to 188° F., such as about 800° to 1200° F. Further, the raw gas stream leaving the gas cooler must be at a temperature above its dew point in order to prevent excessive fouling and possible plugging. The temperature of the raw gas going into the superheater section can be controlled by varying the water level in vessel 1 in the manner previously described. For example, lowering the water level will reduce the area of high heat transfer from the hot gas to the water and thereby reduce the amount of gas cooling, and vice versa. Advantageously, by the subject design the gas cooler may be easily turned up or down with load by independently opening or closing off one or more of the helical tubes. This may be done safely by operating valves in the individual gas lines. These gas flow control valves are located downstream from the gas cooler at the cold end of each gas path, as previously described. Further, along with the efficient cooling of the hot gas stream containing entrained matter without fouling or clogging the tubes, superheated steam is simultaneously produced.

Although modifications and variations of the invention may be made without departing from the spirit and scope thereof, only such limitations should be imposed as are indicated in the appended claims.

We claim:

1. A gas cooler for cooling a hot raw gas stream and simultaneously producing a separate stream of superheated steam comprising:

(1) a closed vertical cylindrically shaped pressure vessel with an upper central outlet for the removal of superheated steam produced therein, an inlet near the lower end of said vessel for introducing and partially filling said vessel with boiler feed water;

(2) a refractory lined hot gas inlet chamber with a gas inlet and a plurality of gas outlets, said gas inlet chamber being attached to the bottom end of said pressure vessel;

(3) a plurality of uniformly spaced vertical bundles of helical tubes extending lengthwise in a portion of said vessel with a portion only of each bundle of helical tubes being submerged in said boiler feed water and providing a free space above and around that portion of each bundle of helical tubes which extends above the water level for the passage of steam; baffle means located above said water level in order to confine the upward flow path of the saturated steam produced in said vessel so that it more directly contacts the external surfaces of the unsubmerged portions of said bundles of helical tubes; wherein said baffle means comprises a transverse disc with circular holes through which pass said plurality of vertical bundles of helical tubes, and a vertical conduit having a central longitudinal axis that is parallel to that of the pressure vessel surrounds each of said bundles of helical tubes and is radially spaced therefrom with the lower ends of said conduits being perpendicularly attached to said transverse disc, and each of said vertical conduits is open at each end and extends upward from each hole to the upper portion or end of said bundles of helical tubes; wherein said baffle means with or without a demister means is fixed in place or is supported by a floating means that floats on the water level; and wherein near the lower ends of said bundles of helical tubes the helical tubes have gas outlet means for the discharge of cooled raw gas from the vessel and water cooled gas inlet means which extend through the lower end of the vessel and are in communication with said hot gas inlet chamber and;

(4) means for controlling the level of the boiler feed water in the vessel.

2. The gas cooler of claim 1 wherein each of the vertical bundles of helical tubes in (3) surrounds an elongated cylindrical pipe along its length wherein said pipe is open at each end.

3. The gas cooler of claim 2 wherein the walls of each pipe are provided with a plurality of holes extending from the lowest water level to the upper end of the pipe.

4. The gas cooler of claim 1 wherein said baffle means is provided above said demister means.

5. In a process for cooling the raw gas stream from a partial oxidation process and simultaneously producing superheated steam by indirect heat exchange between $H_2O$ and the raw gas stream, the improvement which comprises:

(1) continuously introducing boiler feed water upwardly into a closed vertical pressure vessel so that said vessel is partially filled with said boiler feed water, said vessel containing a plurality of uniformly spaced vertical bundles of helical tubes extending lengthwise in a portion of said vessel with a portion only of each bundle of helical tubes being submerged in said boiler feed water;

(2) simultaneously passing a hot raw gas stream from the partial oxidation of a gaseous or liquid hydrocarbonaceous fuel or a solid carbonaceous fuel with a free-oxygen containing gas through said helical tubes in indirect heat exchange with said boiler feed water so as to boil said water and to produce saturated steam; and (3) passing the saturated steam from (2) optionally through a demister means, and over the outside surfaces of the unsubmerged portions of said plurality of bundles of helical tubes contained in said same vessel in indirect heat exchange with the partially cooled raw gas stream flowing through said unsubmerged portions of said bundles of helical tubes, thereby cooling said raw gas stream and producing superheated steam; and removing from said pressure vessel at least one stream of cooled raw gas, and a separate stream of superheated steam; wherein the upward flow path of the saturated steam produced in (2) is confined by a baffle means so that it more directly contacts the external surfaces of the unsubmerged portion of said bundles of helical tubes; and wherein the baffle means and optionally the demister means floats or is fixed in place above the boiler feed water level.

* * * * *